US012540288B2

(12) United States Patent
Standen et al.

(10) Patent No.: US 12,540,288 B2
(45) Date of Patent: Feb. 3, 2026

(54) THERMALLY STABLE, LOW TRACTION COEFFICIENT LUBRICANT

(71) Applicant: The Lubrizol Corporation, Wickliffe, OH (US)

(72) Inventors: Patricia Standen, Belper (GB); William R.S. Barton, Belper (GB); Thomas S. Corrigan, Lakewood, OH (US); Sona Sivakova, Painesville, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/278,206

(22) PCT Filed: Feb. 28, 2022

(86) PCT No.: PCT/US2022/018097

§ 371 (c)(1),
(2) Date: Aug. 22, 2023

(87) PCT Pub. No.: WO2022/187122

PCT Pub. Date: Sep. 9, 2022

(65) Prior Publication Data

US 2024/0150669 A1 May 9, 2024

Related U.S. Application Data

(60) Provisional application No. 63/155,558, filed on Mar. 2, 2021.

(51) Int. Cl.

| | |
|---|---|
| ***C10M 143/02*** | (2006.01) |
| ***C10M 129/70*** | (2006.01) |
| ***C10M 129/72*** | (2006.01) |
| ***C10M 143/04*** | (2006.01) |
| ***C10M 169/04*** | (2006.01) |
| ***C10N 20/00*** | (2006.01) |
| ***C10N 20/04*** | (2006.01) |
| ***C10N 30/02*** | (2006.01) |
| ***C10N 40/04*** | (2006.01) |

(52) U.S. Cl.

CPC ..... *C10M 143/02* (2013.01); *C10M 129/70* (2013.01); *C10M 129/72* (2013.01); *C10M 143/04* (2013.01); *C10M 169/04* (2013.01); *C10M 2203/1025* (2013.01); *C10M 2205/022* (2013.01); *C10M 2205/024* (2013.01); *C10M 2207/281* (2013.01); *C10M 2207/282* (2013.01); *C10M 2217/06* (2013.01); *C10N 2020/04* (2013.01); *C10N 2020/071* (2020.05); *C10N 2030/02* (2013.01); *C10N 2040/04* (2013.01)

(58) Field of Classification Search

CPC ..... C10M 129/70; C10M 129/72; C10M 143/02; C10M 143/04; C10M 169/04; C10M 2203/1025; C10M 2205/022; C10M 2205/024; C10M 2207/281; C10M 2207/282; C10M 2217/06; C10N 2020/04; C10N 2020/071; C10N 2030/02; C10N 2040/04

See application file for complete search history.

(56) References Cited

U.S. PATENT DOCUMENTS

| | | | | |
|---|---|---|---|---|
| 5,039,437 | A * | 8/1991 | Martella | C10L 1/1981 508/572 |
| 2013/0203638 | A1* | 8/2013 | Crawley | C10M 133/12 508/306 |
| 2017/0166828 | A1 | 6/2017 | Rettemeyer et al. | |
| 2020/0032160 | A1* | 1/2020 | Komatsubara | C10M 145/14 |

FOREIGN PATENT DOCUMENTS

| | | | | |
|---|---|---|---|---|
| EP | 2626405 | A1 * | 8/2013 | C10M 125/08 |
| WO | 20180022071 | A1 | 2/2018 | |
| WO | WO-2018190431 | A1 * | 10/2018 | C10M 145/14 |
| WO | WO-2019035905 | A1 * | 2/2019 | C10M 149/04 |

* cited by examiner

*Primary Examiner* — Latosha Hines
(74) *Attorney, Agent, or Firm* — Joseph A. Svarovsky; Christopher P. Demas; Michael A. Miller

(57) ABSTRACT

The disclosed technology relates to lubricants for driveline and industrial gears containing a combination of viscosity modifiers along with optional esters, as well as a method of lubricating driveline and industrial gears with such a lubricant.

24 Claims, No Drawings

THERMALLY STABLE, LOW TRACTION COEFFICIENT LUBRICANT

CROSS REFERENCE TO RELATED APPLICATION

This application claims priority from PCT Application Serial No. US2022/018097 filed on Feb. 28, 2022, which claims the benefit of U.S. Provisional Application No. 63/155,558 filed on Mar. 2, 2021, the entirety of which is hereby incorporated by reference.

BACKGROUND OF THE INVENTION

The disclosed technology relates to lubricants for driveline and industrial gears containing a combination of viscosity modifiers along with optional esters, as well as a method of lubricating driveline and industrial gears with such a lubricant.

Market demands are driving lubricating fluids towards lower viscosities in an effort to minimize energy losses due to mechanical operations. At lower viscosities it becomes increasingly difficult to achieve the performance requisite of driveline and industrial lubricants. For example, the removal of viscosity modifier to achieve lower viscosity fluids can be detrimental to thermal stability as well as traction performance. New solutions are needed to address these problems.

SUMMARY OF THE INVENTION

The disclosed technology, therefore, solves the problem of providing an improved combination of clean operation with minimized viscosity increase along with reductions in traction and friction and improved efficiency performance by combining two types of viscosity modifiers along with optional esters.

Thus, one aspect of the technology disclosed herein is directed to a lubricant composition containing a) a hydrocarbon lubricating base stock, and b) a viscosity modifier composition.

The viscosity modifier composition itself will contain i) at least one olefin polymer having a number average molecular weight ("Mn") as measured by Gel Permeation Chromatography ("GPC") with a polystyrene standard of about 1000 to about 10,000, and ii) at least one grafted olefin polymer having an Mn as measured by GPC with a polystyrene standard of about 1000 to about 10,000, comprising carboxylic acid functionality or a reactive equivalent thereof grafted onto the polymer backbone, wherein the carboxylic acid functionality or reactive equivalent thereof is further reacted with an amine.

The lubricant composition can additionally contain a carboxylic acid ester. The carboxylic acid ester can be, for example, a carboxylic acid mono-ester, a dicarboxylic acid di-ester, or a combination thereof.

The technology also provides a method of lubricating a driveline device or an industrial gear with a composition as described, and operating the driveline device or industrial gear.

DETAILED DESCRIPTION OF THE INVENTION

Various preferred features and embodiments will be described below by way of non-limiting illustration.

Hydrocarbon Lubricating Base Stock

One component of the disclosed technology is a hydrocarbon lubricating base stock. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic hydrocarbon lubricating oils suitable for use include Group IV oils or polyalpha olefins (PAO). Group IV oils include hydrocarbon oils such as polymerized and interpolymerized olefins (e.g., polybutylenes, polypropylenes, propylene-isobutylene polymers); poly(1-hexenes), poly(1-octenes), poly(1-decenes), and mixtures thereof.

Oils of lubricating viscosity may also be defined as specified in the American Petroleum Institute (API) Base Oil Interchangeability Guidelines (2011). The base oil groups suitable for use include Group II and Group II+. Group III and Group III+, and Group IV oils. Group II and Group III oils have a sulfur content ≤0.03 wt %, and ≥90 wt % saturates. Group II oils have a viscosity index 80 to less than 120, while Group III oils have a viscosity index ≥120. Group II+ base oil refers to a API Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57. Group III+ base oil are characterized by having significantly lower cycloparaffinic content and higher isoparaffinic oil relative to the corresponding Group III base oils, resulting in an increase in VI in the III+ oil relative to the III oil by 4 to 10 units. Group III+ base oils encompass wax isomerates, such as gas-to-liquid ("GTL") oils which include oils produced by Fischer-Tropsch reactions as well as other GTL oils. Group IV oils include all polyalphaolefins (PAOs).

The hydrocarbon lubricating base stock may be an API Group IV oil, or mixtures thereof, i.e., a polyalphaolefin. The polyalphaolefin may be prepared by metallocene catalyzed processes or from a non-metallocene process.

The hydrocarbon lubricating base stock may comprise an API Group II oil, or mixtures thereof. The hydrocarbon lubricating base stock may comprise an API Group II+ oil, or mixtures thereof. The hydrocarbon lubricating base stock can also be a Group III oil, or mixtures thereof. The hydrocarbon lubricating base stock may comprise an API Group III+ oil, or mixtures thereof. The hydrocarbon lubricating base stock can also be a Group IV oil, or mixtures thereof. The hydrocarbon lubricating base stock may comprise a mixture of at least two of an API Group II oil, Group II+ oil, API Group III oil, Group III+ oil, and API Group IV oil.

The hydrocarbon lubricating base stock, or base oil, will overall have a kinematic viscosity at 100° C. of 2 to 10 cSt or, in some embodiments 2.25 to 9 or 2.5 to 6 or 7 or 8 cSt, as measured by ASTM D445. Kinematic viscosities for the base oil at 100° C. or from about 3.5 to 6 or from 6 to 8 cSt are also suitable.

The amount of the hydrocarbon lubricating base stock present is typically the balance remaining after subtracting from 100 wt % the sum of the amount of the performance additives in the composition. Illustrative amounts may include 50 to 99 percent by weight, or 60 to 98, or 70 to 95, or 80 to 94, or 85 to 93 percent.

Viscosity Modifier Composition

The technology also includes a viscosity modifier composition combining i) an olefin polymer, and ii) a grafted olefin polymer. As used herein, the term "a," or "an," as in "a" viscosity modifier, or "an" olefin polymer, is not limited to just one of the stated elements, but is used to mean "at least one," which includes one or more of the stated elements, as well as two or more, three or more and so on.

i) Olefin Polymer

The olefin polymer may be prepared from ethylene and propylene or it may be prepared from ethylene and a higher olefin within the range of $C_3$-$C_{10}$ alpha-monoolefins. In certain embodiments, the olefin polymer may be prepared from isobutylene or isoprene.

More complex polymer substrates, often designated as interpolymers, may be prepared using a third component. The third component generally used to prepare an interpolymer substrate may be a polyene monomer selected from conjugated or non-conjugated dienes and trienes. The non-conjugated diene component may be one having from about 5 to about 14 carbon atoms. The diene monomer may be characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer.

A triene component may also be present, which will have at least two non-conjugated double bonds and up to about 30 carbon atoms. Typical trienes include 1-isopropylidene-3a, 4,7,7a-tetrahydroindene, 1-isopropylidenedicyclopentadiene, and 2-(2-methylene-4-methyl-3-pentenyl)-[2.2.1] bicyclo-5-heptene.

Suitable backbone polymers of the olefin polymer variety include ethylene propylene polymers, ethylene-propylene-alpha olefin terpolymers, ethylene-alpha olefin polymers, ethylene propylene polymers further containing a non-conjugated diene, and isobutylene/conjugated diene polymers.

Ethylene-propylene or higher alpha monoolefin polymers may consist of 15 to 80 mole % ethylene and 20 to 85 mole % propylene or higher monoolefin, in some embodiments, the mole ratios being 30 to 80 mole % ethylene and 20 to 70 mole % of at least one $C_3$ to $C_{10}$ alpha monoolefin, for example, 40 to 80 mole % ethylene and 20 to 60 mole % propylene. In another embodiment, the ethylene-propylene or higher alpha monoolefin polymers may consist of 15 to 80 mole % propylene and 20 to 85 mole % ethylene or higher monoolefin, in some embodiments, the mole ratios being 30 to 80 mole % propylene and 20 to 70 mole % of at least one $C_3$ to $C_{10}$ alpha monoolefin, for example, 45 to 75 mole % propylene and 25 to 55 mole % ethylene, or 50 to 75 mole % propylene and 25 to 50 mole % ethylene. Terpolymer variations of the foregoing polymers may contain up to 15 mole % of a non-conjugated diene or triene.

In these embodiments, the polymer substrate, such as the ethylene polymer or terpolymer, can be substantially linear and oil-soluble, and is, in an embodiment, a liquid. Also, in certain embodiments the polymer can be in forms other than substantially linear, that is, it can be a branched polymer or a star polymer. The polymer can also be a random polymer or a block polymer, including di-blocks and higher blocks, including tapered blocks and a variety of other structures. These types of polymer structures are known in the art and their preparation is within the abilities of the person skilled in the art.

The term polymer is used generically to encompass ethylene and/or higher alpha monoolefin polymers, copolymers, terpolymers or interpolymers. These materials may contain minor amounts of other olefinic monomers so long as their basic characteristics are not materially changed.

The olefin polymer of the disclosed technology may have a number average molecular weight (by gel permeation chromatography, polystyrene standard), which can typically be about 1000 to about 10,000, or about 1250 to about 9500, or about 1500 to about 9000, or about 1750 to about 8500, or about 2000 to about 8000, or about 2500 to about 7000 or 7500, or even about 3000 to about 6500, or about 4000 to about 6000. In some cases the number average molecular weight can be from about 1000 to 5000, or from about 1500 or 2000 to about 4000.

ii) Grafted Olefin Polymer

Another component is a grafted copolymer that is a condensation reaction product of an olefin polymer having carboxylic acid (or equivalent) functionality grafted thereon, the grafted olefin reacted with a monoamine or a polyamine which may have a single primary amino group. If the olefin polymer is an ethylene/propylene copolymer, then said polyamine is not a poly(ethylene amine).

The polymer substrate will be an olefin polymer such as that described above. The olefin polymer substrate employed in the derivatized graft copolymer will contain grafted carboxylic acid functionality or a reactive equivalent of carboxylic acid functionality (e.g., anhydride or ester). The reactive carboxylic acid functionality will typically be present as a pendant group attached by, for instance, a grafting process.

An ethylenically unsaturated carboxylic acid material is typically radically grafted onto the polymer backbone. These materials which are attached to the polymer typically contain at least one ethylenic bond (prior to reaction) and at least one, such as two, carboxylic acid (or its anhydride) groups or a polar group which is convertible into said carboxyl groups by oxidation or hydrolysis. Maleic anhydride or a derivative thereof is suitable. It grafts onto the olefin polymer, (e.g., ethylene copolymer or terpolymer) to give two carboxylic acid functionalities. Examples of additional unsaturated carboxylic materials include maleic anhydride, itaconic anhydride, or the corresponding dicarboxylic acids, such as maleic acid, fumaric acid and their esters, as well as cinnamic acid and esters thereof.

The ethylenically unsaturated carboxylic acid material may be radically grafted onto the polymer (such as the ethylene/propylene copolymer). The free-radical induced grafting of ethylenically unsaturated carboxylic acid materials may also be conducted in solvents, such as hexane or mineral oil. It may be carried out at an elevated temperature in the range of 100° C. to 250° C., e.g., 120° C. to 190° C., or 150° C. to 180° C., e.g., above 160° C.

The free-radical initiators which may be used include peroxides, hydroperoxides, and azo compounds, typically those which have a boiling point greater than about 100° C.

and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator may be used in an amount of 0.005% to 1% by weight based on the weight of the reaction mixture solution. The grafting may be carried out in an inert atmosphere, such as under nitrogen blanketing. The resulting polymer intermediate is characterized by having carboxylic acid acylating functions within its structure.

In an alternative embodiment, the unsaturated carboxylic acid material, such as maleic anhydride, can be first condensed with a monoamine or polyamine, typically having a single primary amino group (described below) and the condensation product itself then grafted onto the polymer backbone in analogous fashion to that described above.

The amount of the reactive carboxylic acid on the polymer chain, and in particular the amount of grafted carboxylic acid on the chain is typically 0.5 to 8 weight percent, or 1 to 7 weight percent, or 1.5 to 6 weight percent, based on the weight of the polymer backbone, or in some embodiments 2 to 5 weight percent. In some embodiments the amount of the reactive carboxylic acid on the polymer chain, and in particular the amount of grafted carboxylic acid on the chain can be from about 1 to about 2, or in other embodiments from about 2 to 3, or from about 3 to 4 weight percent or 4 to 5 weight percent. These numbers represent the amount of carboxyl-containing species with particular reference to maleic anhydride as the graft material. The amounts may be adjusted to account for carboxyl-containing species having higher or lower molecular weights or greater or lesser amounts of acid functionality per molecule, as will be apparent to the person skilled in the art. The grafting may be of an extent to provide an acid functionalized polymer having a total acid number (TAN per ASTM D664) of 5 to 100, 10 to 80, or 15 to 75, or 20 to 70, or about 20 to about 60 or 65 mgKOH/g.

The acid-containing polymer is reacted with a monoamine or a polyamine typically having a single primary amino group. If the olefin polymer is an ethylene/propylene copolymer, then said polyamine is not a poly(ethyleneamine). The reaction may consist of condensation to form an imide, amide, or half-amide or amide-ester (assuming a portion of alcohol is also reacted) or an amine salt. A primary amino group will typically condense to form an amide or, in the case of maleic anhydride, an imide. It is noted that in certain embodiments the amine will have a single primary amino group, that is, it will not have two or more primary amino groups (except perhaps a very small an inconsequential amount of additional primary amino groups within the entire amine component, e.g., less than 5% or 2% or 1% or 0.5%, or 0.01 to 0.1%, especially 1% or less, such as 0.01 to 1%, of amine groups being primary). This feature will minimize the amount of crosslinking that might otherwise occur. Poly(ethyleneamine)s may generally, and in an oversimplified manner, be depicted as $H_2N—(C_2H_4—NH—)_n—C_2H_4—NH_2$, where n may be, for instance, 2 through 6. These typically have on average about 2 primary amino groups, so their use is typically undesirable for functionalization of ethylene/propylene copolymers, so that any undesirable crosslinking may be minimized or avoided. In those embodiments in which the polyamine is not a poly(ethyleneamine), the amine component employed to make the condensation product will be free of or substantially free of poly(ethyleneamine), such as less than 5 percent by weight of the amine component is poly(ethyleneamine), or less than 1 percent, or 0.01 to 0.1 percent by weight.

Suitable primary amines may include aromatic amines, such as amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, such as those derived from naphthalene. Examples of aromatic amines include aniline, N-alkylanilines such as N-methylaniline, and N-butylaniline, di-(para-methylphenyl)amine, naphthylamine, 4-aminodiphenylamine, N,N-dimethylphenylenediamine, 4-(4-nitrophenylazo)aniline (disperse orange 3), sulfamethazine, 4-phenoxyaniline, 3-nitroaniline, 4-aminoacetanilide, 4-amino-2-hydroxy-benzoic acid phenyl ester (phenyl amino salicylate), N-(4-amino-5-methoxy-2-methylphenyl)-benzamide (fast violet B), N-(4-amino-2,5-dimethoxy-phenyl)-benzamide (fast blue RR), N-(4-amino-2,5-diethoxy-phenyl)-benzamide (fast blue BB), N-(4-amino-phenyl)-benzamide and 4-phenylazoaniline. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which an amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide (i.e., $—NH—+—NH—COCH_2CH(CH_3)NH_2$). Additional aromatic amines include aminocarbazoles, aminoindoles, aminopyrroles, aminoindazolinones, aminoperimidines, mercaptotriazoles, aminophenothiazines, aminopyridines, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl)amino} butanamide. Other aromatic amines which can be used include various aromatic amine dye intermediates containing multiple aromatic rings linked by, for example, amide structures. Examples include materials of the general structure $\phi$-CONH-$\phi$-$NH_2$ where the phenyl groups may be substituted. Suitable aromatic amines include those in which the amine nitrogen is a substituent on an aromatic carboxylic compound, that is, the nitrogen is not $sp^2$ hybridized within an aromatic ring.

The amine may also be non-aromatic, or in other words, an amine in which an amino nitrogen is not attached directly to a carbon atom of an aromatic ring, or in which an amine nitrogen is not a part of an aromatic ring, or in which an amine nitrogen is not a substituent on an aromatic carboxylic compound. In some instances such non-aromatic amines may be considered to be aliphatic, or cycloaliphatic. Such amines may be straight, or branched or functionalized with some functional group. The non-aromatic amines can include monoamines having, e.g., 1 to 8 carbon atoms, such as methylamine, ethylamine, and propylamine, as well as various higher amines. Diamines or polyamines can also be used, and typically will have only a single primary amino group. Examples include dimethylaminopropylamine, diethylaminopropylamine, dibutylaminopropylamine, dimethylaminoethylamine, diethylaminoethylamine, dibutylaminoethylamine, 1-(2-aminoethyl)piperidine, 1-(2-aminoethyl) pyrrolidone, N,N-dimethylethylamine; 3-(dimethylamino)-1-propylamine; O-(2-aminopropyl)O'-(2-methoxyethyl) polypropylene glycol; N,N-dimethyldipropylenetriamine, aminoethylmorpholine, 3-morpholinopropylamine; aminoethylethyleneurea and aminopropylmorpholine.

In certain embodiments non-aromatic amines can be used alone or in combination with each other or in combination with aromatic amines. The amount of aromatic amine may, in some embodiments, be a minor amount compared with the amount of the non-aromatic amines, or in some instance, the composition may be substantially free or free of aromatic amine.

In certain embodiments the grafted olefin polymer may have a nitrogen content, calculated using ASTM D5291, of 0.05 to 3 percent by weight, or 0.1 to 2.5, or 0.15 to 2, or 0.2 to 1.75, or 0.25 to 1.6 percent by weight.

Amount of Olefin and Grafted Olefin Polymers

The olefin polymer and the grafted olefin polymer can be added to the lubricant composition in amounts to achieve the desired viscosity grade.

In general, the amount of the olefin polymer may be 0.1 to 20, or 1 to 19, or 2.5 to 18, or 5 to 17 percent by weight, or 10 to 16 percent by weight of the lubricant composition or may be 10 to 20, or 11 to 19, or 12 to 18, or 13 to 17 percent by weight, or 14 to 16 percent by weight of the lubricant composition.

In general, the amount of the grafted olefin polymer may be 0.1 to 10, or 0.2 to 9, or 0.3 to 8, or 0.4 to 7 percent by weight, or 0.5 to 6 percent by weight of the lubricant composition.

In an embodiment, the lubricant composition may contain from 10 to 20 percent by weight olefin polymer and 0.1 to 10 percent by weight grafted olefin polymer. In an embodiment, the lubricant composition may contain from 11 to 19 percent by weight olefin polymer and 0.2 to 9 percent by weight grafted olefin polymer. In an embodiment, the lubricant composition may contain from 12 to 18 percent by weight olefin polymer and 0.3 to 8 percent by weight grafted olefin polymer. In an embodiment, the lubricant composition may contain from 13 to 17 percent by weight olefin polymer and 0.4 to 7 percent by weight grafted olefin polymer. In an embodiment, the lubricant composition may contain from 14 to 16 percent by weight olefin polymer and 0.5 to 6 percent by weight grafted olefin polymer.

In any event, the olefin polymer and the grafted olefin polymer can be in the composition at a ratio of between about 90/10 wt % to about 40/60 wt %. In some embodiments, the olefin polymer and the grafted olefin polymer can be in the composition at a ratio of between about 85/15 wt % to about 45/55 wt %. In some embodiments, the olefin polymer and the grafted olefin polymer can be in the composition at a ratio of between about 80/20 wt % to about 50/50 wt %.

Ester Base Stock

The lubricating composition may optionally include at least one carboxylic acid ester, either in the form of a carboxylic acid mono-ester or mixtures thereof, dicarboxylic acid di-ester or mixtures thereof, or a combination of carboxylic acid mono-ester or mixtures thereof and dicarboxylic acid di-ester and mixtures thereof.

The carboxylic acid-mono-ester is a molecule having a formula RC(O)OR', where RC(O)O— represents the carboxylic acid moiety and R' represents a hydrocarbyl group.

The R group of the carboxylic acid moiety, RC(O)O—, of the carboxylic acid mono-ester can be a $C_2$ to $C_{18}$ linear or branched hydrocarbyl group. In some embodiments, the R group of the carboxylic acid moiety of the carboxylic acid mono-ester can be a $C_4$ to $C_{15}$, or a $C_6$ to $C_{12}$ linear or branched hydrocarbyl group. The hydrocarbyl group can, in some embodiments, include heteroatoms, but in many instances the hydrocarbyl group will be an alkyl group. Thus, in some embodiments, the R group of the carboxylic acid moiety of the carboxylic acid mono-ester can be a $C_2$ to $C_{18}$, $C_4$ to $C_{18}$, or a $C_6$ to $C_{12}$ or even a $C_8$ to $C_{12}$ linear or branched alkyl group.

Carboxylic acid from which the RC(O)O— moiety may be derived include, but are not limited to, for example, lauric acid, tallow acid, oleic acid, palmitic acid, and the like. Thus, the carboxylic acid mono-ester may be, for example, a lauric acid mono-ester, tallow acid mono-ester, oleic acid mono-ester, palmitic acid mono ester, and combinations thereof.

The hydrocarbyl group, R', of the carboxylic acid mono-ester can be $C_6$ to $C_{12}$ linear or branched alkyl moiety. Alkyl moieties envisaged include, but are not limited to, for example, a hexyl moiety, ethylhexyl moiety, methylpentyl moiety, ethylpentyl moiety, dimethylhexyl moiety, ethylmethylhexyl moiety and the like.

In an embodiment, the carboxylic acid mono-ester may be, for example, 2-ethylhexyl tallate, 2-ethylhexyl oleate, 2-ethylhexyl laurate, 2-ethylhexyl palmitate, and combinations thereof.

The carboxylic acid mono-ester may be present in the lubricant composition at from about 1 or 1.5 to about 15 wt. %, or from about 2 to about 12.5, or about 10 to about 15 wt. %, or even from about 3 to about 10 wt. % or about 4 to 8 wt. %.

The dicarboxylic acid di-ester is a molecule having a formula R'O(O)CRC(O)OR', where —O(O)CRC(O)O— represents the dicarboxylic acid moiety and each R' represents a hydrocarbyl group.

The R group of the dicarboxylic acid moiety, —O(O)CRC(O)O—, of the dicarboxylic acid di-ester can be a $C_3$ to $C_{12}$ or $C_6$ to $C_{12}$ linear or branched hydrocarbyl group. The hydrocarbyl group can, in some embodiments, include heteroatoms, but in many instances the hydrocarbyl group will be an alkyl group. Thus, in some embodiments, the R group of the carboxylic acid moiety of the carboxylic acid mono-ester can be a $C_3$ to $C_{12}$, or a $C_6$ to $C_{12}$ linear or branched alkyl group.

Dicarboxylic acid from which the —O(O)CRC(O)O— moiety may be derived include, but are not limited to, for example, glutaric acid, adipic acid, azelaic acid, sebacic acid, and the like. Thus, the dicarboxylic acid di-ester may be, for example, a glutaric acid di-ester, adipic acid di-ester, azelaic acid di-ester, sebacic acid di-ester, and combinations thereof.

The hydrocarbyl groups, R', of the dicarboxylic acid di-ester can be $C_6$ to $C_{12}$ linear or branched alkyl moieties. Alkyl moieties envisaged include, but are not limited to, for example, a hexyl moiety, ethylhexyl moiety, methylpentyl moiety, ethylpentyl moiety, dimethylhexyl moiety, ethylmethylhexyl moiety and the like.

In an embodiment, the dicarboxylic acid di-ester may be, for example, di-2-ethylhexyl azelate, di-isotridecyl adipate, di-isooctyl adipate, and combinations thereof.

The dicarboxylic acid di-ester may be present in the lubricant composition at from about 1 or 1.5 to about 15 wt. %, or from about 2 to about 12.5, or about 10 to about 15 wt. %, or even from about 3 to about 10 wt. %. or about 4 to 8 wt. %.

The total amount of carboxylic acid mono-ester and dicarboxylic acid di-ester may be from 2 or 3 to about 30 wt. %, or from about 4 to about 25, or about 20 to about 30 wt. %, or even from about 6 to about 20 wt. %. or about 8 to 16 wt. %, or 10 to 14 wt. %.

The ratio of carboxylic acid mono-ester to dicarboxylic acid di-ester may be from 90 wt. %:10 wt. % to 10 wt. %:90 wt. %, or 80 wt. %:20 wt. % to 20 wt. %:80 wt. %, or even 75 wt. %:25 wt. % to 25 wt. %:75 wt. %. In embodiments, the ratio of carboxylic acid mono-ester to dicarboxylic acid di-ester may be from 60 wt. %:40 wt. % to 40 wt. %:60 wt. %, or even 55 wt. %:45 wt. % to 45 wt. %:55 wt. %, or some cases even 50 wt. %:50 wt. %.

Other Additives

The lubricant composition can be employed in either driveline applications or in industrial gear applications. As a driveline lubricant, the lubricant composition can contain other additives typically used in driveline applications, including, for example, detergents, dispersants, extreme pressure agents, friction modifiers, antiwear agents, corrosion inhibitors, viscosity modifiers, anti-oxidants, oil-soluble titanium compounds, metal alkylthiophosphate, organo-sulfides, including polysulfides, such as sulfurized olefins, thiadiazoles and thiadiazole adducts such as post treated dispersants.

The organo-sulfide can be present in a range of 0 wt % to 6 wt %, 4 wt % to 6 wt %, 0.5 wt % to 3 wt %, 3 wt % to 5 wt %, 0 wt % to 1 wt %, or 0.1 wt % to 0.5 wt % of the lubricating composition.

The organosulfide may alternatively be a polysulfide. In one embodiment at least about 50 wt % of the polysulfide molecules are a mixture of tri- or tetra-sulfides. In other embodiments at least about 55 wt %, or at least about 60 wt % of the polysulfide molecules are a mixture of tri- or tetra-sulfides. The polysulfides include sulfurized organic polysulfides from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide may also be derived from an olefin derived from a wide range of alkenes, typically having one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene, or mixtures thereof. In one embodiment the polysulfide comprises a polyolefin derived from polymerizing, by known techniques, an olefin as described above. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts; phosphosulfurized hydrocarbons.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Further examples of thiadiazole compounds are found in WO 2008,094759, paragraphs 0088 through 0090.

In an embodiment, the lubricant composition can have a total sulfur level from all additives (i.e., not including base oil) of about 0.5 or 0.6 to about 3 wt. %, or from about 0.5 or 0.6 to about 2.5 wt. % or from about 0.5 or 0.6 to about 2 wt. %. In another embodiment, the lubricant composition can have a total sulfur level from all additives (i.e., not including base oil) of about 0.2 to about 0.75 wt %, or from about 0.25 to about 0.5 wt. %.

In an embodiment, the lubricant composition can be substantially free, or free of sulfurized olefin.

Lubricant compositions for automotive gears, axles, and bearings can be distinguished from other lubricant compositions, such as those for engine oils, by the presence of non-metal phosphorous containing compounds. The lubricant composition described herein will contain just such a non-metal phosphorous containing compound. Such compounds can include, for example, phosphorous amine salts, sulfur containing phosphorous amine salts, phosphites, phosphonates, sulfur containing phosphites, sulfur containing phosphonates, and non-metal dithiophosphates. Such compounds can bring to the lubricant composition, alone or in combination, a total phosphorus level of about 0.03 to about 0.5 wt. %, or 0.03 to about 0.35 wt. %, or even about 0.05 to about 0.3 wt. %, or about 0.08 to about 0.2 wt. %, or about 0.13 to about 0.2 wt. %, or about 0.1 to about 0.25 wt. %.

The phosphorous amine salt can be an amine salt of one or more of the following: phosphorus acid esters, dialkyldithiophosphoric acid esters, phosphites, phosphonates, and mixtures thereof. The amine salt of the phosphorus acid ester may comprise any of a variety of chemical structures. In particular, a variety of structures are possible when the phosphorus acid ester compound contains one or more sulfur atoms, that is, when the phosphorus-containing acid is a thiophosphorus acid ester, including mono- or dithiophosphorus acid esters. A phosphorus acid ester may be prepared by reacting a phosphorus compound such as phosphorus pentoxide with an alcohol. Suitable alcohols include those containing up to 30 or to 24, or to 12 carbon atoms, including primary or secondary alcohols such as isopropyl, butyl, amyl, s-amyl, 2-ethylhexyl, hexyl, cyclohexyl, octyl, decyl and oleyl alcohols, as well as any of a variety of commercial alcohol mixtures having, e.g., 8 to 10, 12 to 18, or 18 to 28 carbon atoms. Polyols such as diols may also be used. The amines which may be suitable for use as the amine salt include primary amines, secondary amines, tertiary amines, and mixtures thereof, including amines with at least one hydrocarbyl group, or, in certain embodiments, two or three hydrocarbyl groups having, e.g., 2 to 30 or 8 to 26 or 10 to 20 or 13 to 19 carbon atoms.

In one embodiment, the phosphorous amine salts can include, for example, a substantially sulfur-free alkyl phosphate amine salt having at least 30 mole percent of the phosphorus atoms in an alkyl pyrophosphate structure (sometimes referred to as the POP structure), as opposed to an orthophosphate (or monomeric phosphate) structure, as shown, for example, in the following formula $R^1O(O_2)POP(O_2)OR^1\cdot(R^2{}_3)NH^+$, or variants thereof, where, each $R^1$ is independently an alkyl group of 3 to 12 carbon atoms, and each $R^2$ is independently hydrogen or a hydrocarbyl group or an ester-containing group, or an ether-containing group, provided that at least one $R^2$ group is a hydrocarbyl group or an ester-containing group or an ether-containing group (that is, not $NH_3$).

Further phosphorous amine salts can be the amine salt of a phosphate hydrocarbon ester prepared by reaction between phosphorus pentoxide with an alcohol (having 4 to 18 carbon atoms), followed by a reaction with a primary (e.g., 2-ethylhexylamine), secondary (e.g., dimethylamine), or tertiary (e.g., dimethyloleylamine) amine to form an amine salt of a phosphate hydrocarbon ester.

In one embodiment, sulfur containing amine phosphate salts may be prepared by reacting an alkylthiophosphate with an epoxide or a polyhydric alcohol, such as glycerol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Ethylene oxide and propylene oxide are preferred. The glycols may be aliphatic glycols having from 2 to about 12, or from 2 to about 6, or from 2 or 3 carbon atoms. Glycols include ethylene glycol, propylene glycol, and the like. The alkylthiophosphate, glycols, epoxides, inorganic phosphorus reagents and methods of reacting the same are described in U.S. Pat. Nos. 3,197,405 and 3,544,465 which are incorporated herein by reference for their disclosure to these.

In some embodiments the non-metal phosphorus-containing compound can be a phosphite or a phosphonate. Suitable phosphites or phosphonates include those having at least one hydrocarbyl group with 3 or 4 or more, or 8 or more, or 12 or more, carbon atoms. The phosphite may be a mono-hydrocarbyl substituted phosphite, a di-hydrocarbyl substituted phosphite, or a tri-hydrocarbyl substituted phosphite. The phosphonate may be a mono-hydrocarbyl substituted phosphonate, a di-hydrocarbyl substituted phosphonate, or a tri-hydrocarbyl substituted phosphonate.

In one embodiment the phosphite is sulphur-free i.e., the phosphite is not a thiophosphite.

The phosphite or phosphonate may be represented by the formulae:

XI

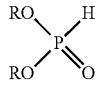

XII

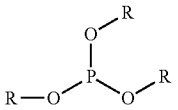

wherein at least one R may be a hydrocarbyl group containing at least 3 carbon atoms and the other R groups may be hydrogen. In one embodiment, two of the R groups are hydrocarbyl groups, and the third is hydrogen. In one embodiment every R group is a hydrocarbyl group, i.e., the phosphite is a tri-hydrocarbyl substituted phosphite. The hydrocarbyl groups may be alkyl, cycloalkyl, aryl, acyclic or mixtures thereof.

In the art, a phosphonate (i.e., formula XI with R=hydrocarbyl) may also be referred to as a phosphite ester. Where one of the R groups in formula XII is an H group, the compound would generally be considered a phosphite, but such a compound can often exist in between the tautomers of formula XI and XII, and thus, could also be referred to as a phosphonate or phosphite ester. For ease of reference, the term phosphite, as used herein, will be considered to encompass both phosphites and phosphonates.

The R hydrocarbyl groups may be linear or branched, typically linear, and saturated or unsaturated, typically saturated.

In one embodiment, the other phosphorus-containing compound can be a $C_{3-8}$ hydrocarbyl phosphite, or mixtures thereof, i.e., wherein each R may independently be hydrogen or a hydrocarbyl group having 3 to 8, or 4 to 6 carbon atoms, typically 4 carbon atoms. Typically the $C_{3-8}$ hydrocarbyl phosphite comprises dibutyl phosphite.

In one embodiment, the phosphorus-containing compound can be a $C_{12-22}$ hydrocarbyl phosphite, or mixtures thereof, i.e., wherein each R may independently be hydrogen or a hydrocarbyl group having 12 to 24, or 14 to 20 carbon atoms, typically 16 to 18 carbon atoms. Typically the $C_{12-22}$ hydrocarbyl phosphite comprises a $C_{16-18}$ hydrocarbyl phosphite. Examples of alkyl groups for $R^3$, $R^4$ and $R^5$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof.

In some embodiments, the other phosphorus containing compound can include both a $C_{3-8}$ and a $C_{12}$ to $C_{24}$ hydrocarbyl phosphite.

In one embodiment, the phosphite ester comprises the reaction product of (a) a monomeric phosphoric acid or an ester thereof with (b) at least two alkylene diols; a first alkylene diol (i) having two hydroxy groups in a 1,4 or 1,5 or 1,6 relationship; and a second alkylene diol (ii) being an alkyl-substitute 1,3-propylene glycol.

Sulfur containing phosphites can include, for example, a material represented by the formula $[R^1O(OR^2)(S)PSC_2H_4(C)(O)OR^4O]_nP(OR^5)_{2-n}(O)H$, wherein $R^1$ and $R^2$ are each independently hydrocarbyl groups of 3 to 12 carbon atoms, or 6 to 8 carbon atoms, or wherein $R^1$ and $R^2$ together with the adjacent O and P atoms form a ring containing 2 to 6 carbon atoms; $R^4$ is an alkylene group of 2 to 6 carbon atoms or 2 to 4 carbon atoms; $R^5$ is hydrogen or a hydrocarbyl group of 1 to about 12 carbon atoms; and n is 1 or 2.

In one embodiment, the other phosphorus containing compound can be a phosphorus containing amide. Phosphorus containing amides can be prepared by reaction of dithiophosphoric acid with an unsaturated amide. Examples of unsaturated amides include acrylamide, N,N'-methylene bisacrylamide, methacrylamide, crotonamide and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807 and 4,876,374 which are incorporated by reference for their disclosures of phosphorus amides and their preparation.

The phosphorus containing compound can also be a dithiophosphate ester can be formed by reaction of a dithiophosphoric acid represented by $(RO)_2PSSH$ with an unsaturated compound. In one embodiment, the unsaturated compounds is an unsaturated carboxylic acid or ester. Examples of unsaturated carboxylic acids or anhydrides include acrylic acids or esters, methacrylate acid or esters, itaconic acid or ester, fumaric acid or esters, and maleic acid, anhydride, or esters.

Other materials may be present in the lubricant composition in their conventional amounts including, for example, viscosity modifiers, dispersants, pour point additives, extreme pressure agents, antifoams, copper anticorrosion agents (such as dimercaptothiadiazole compounds), iron anticorrosion agents, friction modifiers, dyes, fragrances, optional detergents and antioxidants, and color stabilizers, for example.

The final lubricant composition can have a kinematic viscosity at 100° C. by ASTM D445 of 3 to 28, or 3.5 to 26, or even 3 or 4 to 24, or 4.5 to 22 $mm^2/s$. In one embodiment the final lubricant composition can have a kinematic viscosity at 100° C. by ASTM D445 of 3.8 to 5.0, or 5.0 to 6.5, or 6.6 to 8.5, or 8.5 to 11.0 $mm^2/s$. In some embodiments, the lubricant composition can have a kinematic viscosity at 100° C. by ASTM D445 of 5.5 to 7, or 5 to 6.5, or 5 to 6 $mm^2/s$. The final lubricant composition can have a kinematic viscosity at 100° C. by ASTM D445 of 3.8 to 6.5, or 6.5 to 11.0, or even 11.0 to 13.5, or 13.5 to 18.5, or even 18.5 to 28 $mm^2/s$. In some embodiments, the final lubricant composition can have a kinematic viscosity to meet SAE Viscosity grade as shown in the following table:

SAE J306 Specification for Automotive Gear Lubricant Viscosity Classification

| SAE Viscosity Grade | Max Temp for Vis. Of 150,000 cP, ° C. | KV @100° C., cSt min | KV @100° C., cSt max |
|---|---|---|---|
| 70W | −55 | 3.8 | — |
| 75W | −40 | 3.8 | — |
| 80W | −26 | 8.5 | — |
| 85W | −12 | 11.0 | — |
| 65 | | 3.8 | <5.0 |
| 70 | | 5.0 | <6.5 |
| 75 | | 6.5 | <8.5 |
| 80 | — | 8.5 | <11.0 |
| 85 | — | 11.0 | <13.5 |
| 90 | — | 13.5 | <18.5 |
| 110 | — | 18.5 | <24.0 |
| 140 | — | 24.0 | <32.5 |
| 190 | — | 32.5 | <41.0 |
| 250 | — | 41.0 | — |

As a lubricant for industrial gears, the lubricant composition can contain other additives typically used in industrial gear applications, including, for example, foam inhibitors, demulsifiers, pour point depressants, antioxidants, dispersants, metal deactivators (such as a copper deactivator), antiwear agents, extreme pressure agents, viscosity modifiers, or some mixture thereof. The additives may each be present in the range from 50, 75, 100 or even 150 ppm up to 5, 4, 3, 2 or even 1.5 percent by weight, or from 75 ppm to 0.5 percent by weight, from 100 ppm to 0.4 percent by weight, or from 150 ppm to 0.3 percent by weight, where the percent by weight values are with regards to the overall lubricant composition. In other embodiments the other industrial additives, as a total additive package, can be present from 1 to 20, or from 1 to 10 percent by weight of the overall lubricant composition. However, it is noted that some additives, including viscosity modifying polymers, which may alternatively be considered as part of the base fluid, may be present in higher amounts including up to 30, 40, or even 50% by weight when considered separate from the base fluid. The additives may be used alone or as mixtures thereof.

In some embodiments the industrial lubricant additive packages, or the resulting industrial lubricant compositions, include a demulsifier, a corrosion inhibitor, a friction modifier, or combination of two or more thereof. In some embodiments the corrosion inhibitor includes a tolyltriazole. In still other embodiments the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester polymers; one or more carboxylic esters; one or more succinimide dispersants, or any combination thereof.

The disclosed technology provides a method of lubricating a driveline device, such as an automotive gear, axle or transmission, comprising supplying thereto a lubricating composition as described herein, that is, either a lubricating composition having (a) a hydrocarbon lubricating base stock, and (b) a viscosity modifier composition comprising a combination of i) an olefin polymer, and ii) a grafted olefin copolymer, and optionally c) a carboxylic acid ester, and operating the driveline device. In an embodiment, the lubricant composition disclosed herein can be employed to improve the traction coefficient of the lubricated gear at temperatures below 100° C.

The automotive gear may comprise a gear as in a gearbox of a vehicle (e.g., a manual transmission or automated manual transmission) or in an axle or differential, or in other driveline power transmitting driveline devices. The automotive gear may also include bearings. Lubricated gears may include hypoid gears, such as those for example in a rear drive axle. The axle may be from a traditional petroleum powered vehicle, may be from an electrically driven vehicle, or a hybrid thereof. The electrically driven axle can combine an electric motor, power electronics and transmission in a unit directly powering the vehicle's axle.

The disclosed technology also provides a method of lubricating an industrial gear comprising supplying thereto a lubricating composition as described herein, that is, either a lubricating composition having (a) a hydrocarbon lubricating base stock, and (b) a viscosity modifier composition comprising a combination of i) an olefin polymer, and ii) a grafted olefin copolymer, and optionally c) a carboxylic acid ester, and operating the driveline device. In an embodiment, the lubricant composition disclosed herein can be employed to improve the traction coefficient of the lubricated gear at temperatures below 100° C.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

As used herein, the term "about" means that a value of a given quantity is within ±20% of the stated value. In other embodiments, the value is within ±15% of the stated value. In other embodiments, the value is within ±10% of the stated value. In other embodiments, the value is within +5% of the stated value. In other embodiments, the value is within ±2.5% of the stated value. In other embodiments, the value is within ±1% of the stated value.

The invention herein is useful for fully formulated gear oils or industrial gear oils, which may be better understood with reference to the following examples.

EXAMPLES

Copolymer A is an olefin copolymer of ethylene and propylene (43:57) with an Mn of 4900 as measured by Gel Permeation Chromatography ("GPC") with a polystyrene standard.

Functionalized Copolymer B was made by reacting olefin copolymer A with 2 wt % methacrylic acid in the presence of a peroxide initiator. The grafted olefin from this reaction was then further reacted with n-aminopropylmorpholine. The product was diluted with PAO-4 synthetic oil to 80% actives.

A series of fully formulated automotive gear oils were prepared according to the formulations in Table 1 below.

TABLE 1

| Grp III Formulations | | | | | |
|---|---|---|---|---|---|
| | Sample 1 | Sample 2 | Sample 3 | Sample 4 | Sample 5 |
| Copolymer A/ Copolymer B | 100/0 | 80/20 | 50/50 | 20/80 | 0/100 |
| Additive concentrate | 12.5 | 12.5 | 12.5 | 12.5 | 12.5 |
| Pour point depressant | 0.2 | 0.2 | 0.2 | 0.2 | 0.2 |
| Antifoam | 0.02 | 0.02 | 0.02 | 0.02 | 0.02 |
| Copolymer A | 15.5 | 15.2 | 8.5 | 3.8 | |
| Copolymer B | | 3.8 | 8.5 | 15.2 | 19 |
| Grp III Base oil | Sum to 100 | Sum to 100 | Sum to 100 | Sum to 100 | Sum to 100 |
| KV100, cSt | 12.84 | 15.36 | 13.1 | 13.99 | 13.55 |
| KV40, cSt | 75.51 | 94.88 | 78.08 | 85.37 | 82.18 |

These fully formulated lubricating oils were subjected to oxidation testing via the CEC L-48 DKA Oxidation method. In this test, a sample of fluid was heated to 160° C. in a glass tube for 192 hours with 5 L/hour of air purging the fluid. At the end of test, the kinematic viscosity of the fluid is measured at both 40° C. and 100° C. and the tube is rated for deposits. The Aspect is a visual rating of 1, 2 or 3 that is indicative of the cleanliness of the tube that contained the fluid. The lower the number, the cleaner the tube. The results in table 2 below show that when only unfunctionalized olefin copolymer A is present, the viscosity control is good, however the cleanliness rating is higher than desirable. By creating a mixture of functionalized and unfunctionalized copolymer with just 20 wt % of functionalized olefin copolymer, the cleanliness improves without drastically impacting the viscosity performance. If 100% of the viscosity modifier is functionalized olefin copolymer B, the cleanliness ratio is good, but the viscosity at the end of test has increased significantly.

TABLE 2

| Grp III Formulations | | | | | |
|---|---|---|---|---|---|
| DKA performance | Sample 1 | Sample 2 | Sample 3 | Sample 4 | Sample 5 |
| Copolymer A/ Copolymer B | 100/0 | 80/20 | 50/50 | 20/80 | 0/100 |
| KV100, % Change | 38 | 53 | 71 | 116 | 162 |
| KV40, % Change | 47 | 63 | 88 | 156 | 236 |
| Aspect | 2 | 1 | 1 | 1 | 1 |

Given that the viscosity modifier mixture containing 80 wt % copolymer A and 20 wt % copolymer B (Sample 2) showed both good cleanliness and good viscosity control after oxidation, additional mixtures were made containing 70 and 90 weight percent of the copolymer A mixed with 30 and 10 wt % respectively of the copolymer B.

TABLE 3

| Grp III Formulations | | | |
|---|---|---|---|
| | Sample 6 | Sample 7 | Sample 8 |
| Additive concentrate | 12.5 | 12.5 | 12.5 |
| Copolymer A/ Copolymer B | 70/30 | 80/20 | 90/10 |
| Grp III Base oil | Sum to 100 | Sum to 100 | Sum to 100 |
| KV100, cSt | 12.59 | 12.05 | 12.58 |
| KV40, cSt | 74.22 | 70.04 | 73.71 |

Samples 6-8 were also evaluated via the CEC L-48 DKA Oxidation method. The results shown in Table 4 indicate that 10 wt % of copolymer B is not enough to improve the cleanliness Aspect rating to a 1 from a 2.

TABLE 4

| Grp III Formulations | | | |
|---|---|---|---|
| | Sample 6 | Sample 7 | Sample 8 |
| Copolymer A/ Copolymer B | 70/30 | 80/20 | 90/10 |
| KV100 % Change | 56 | 47 | 44 |
| KV40 % Change | 68 | 55 | 51 |
| Aspect | 1 | 1 | 2 |

Given the promising results in the DKA oxidation test, the 80/20 mixture of viscosity modifiers was tested in the L-60-1 (ASTM D5704) extended 200 hour test with three different additive packages.

TABLE 5

| Grp IV Formulations | | | |
|---|---|---|---|
| | Sample 9 | Sample 10 | Sample 11 |
| Add Pack 1 wt. % | 10 | — | — |
| Add Pack 2 wt. % | — | 12.5 | — |
| Add Pack 3 wt. % | — | — | 10 |
| BORON ppm | 221 | 91 | 231 |
| PHOSPHORUS ppm | 1334 | 1341 | 1623 |
| SULFUR ppm | 21211 | 20800 | 18830 |

TABLE 5-continued

| Grp IV Formulations | | | |
|---|---|---|---|
| | Sample 9 | Sample 10 | Sample 11 |
| ZINC ppm | | | 336 |
| Copolymer A | 13.2 | 13.2 | 13.2 |
| Copolymer B | 3.3 | 3.3 | 3.3 |
| Oil of lubricating viscosity | Sum to 100 | Sum to 100 | Sum to 100 |

Table 6 shows the varnish and sludge ratings in the L-60-1 extended 200 hr test for each fluid, all of which would be accepted within the industry.

TABLE 6

| L-60-1 (200 hr) | L-60-1 (50 hour minimum passing requirements) | Sample 9 | Sample 10 | Sample 11 |
|---|---|---|---|---|
| Varnish (merit) | 7.5 | 9.7 | 9.2 | 10 |
| Sludge | 9.4 | 9.6 | 9.7 | 9.8 |

While cleanliness is an important performance attribute, fluid efficiency is another key performance parameter. One way of investigating fluid efficiency is to measure the traction coefficient of the fluid. Traction is the internal resistance of a fluid and has a dominant effect in the mixed and boundary lubrication regimes. The copolymers described here were then evaluated using a standard mini-traction machine (MTM) with a frictional force of 1.0 GPa pressure applied. Each fluid was run at 6 temperatures using a slide to roll ratio from 0.025 to 50. Samples 12-15 all contained the same additive package, commercially available from the Lubrizol Corporation as Anglamol® 2042. Sample 12 contained only copolymer A, sample 13 contained only copolymer B, while sample 14 contained the 80/20 mixture of copolymer A/copolymer B without a pour point depressant and sample 15 contained the 80/20 mixture of copolymer A/copolymer B with a pour point depressant. Selected traction coefficient data for these fluids can be found in Table 7.

TABLE 7

| Grp III Formulations | | | | |
|---|---|---|---|---|
| | Sample 12 | Sample 13 | Sample 14 | Sample 15 |
| Baseoil | Grp III | Grp III | Grp III | Grp III |
| Baseoil viscosity at 100° C. | 4.25 cSt | 4.25 cSt | 4.25 cSt | 4.25 cSt |
| Additive package | 12.5 | 12.5 | 12.5 | 12.5 |
| Copolymer A | 14.4 | | 12 | 12 |
| Copolymer B | | 17.5 | 3 | 3 |
| Pour point depressant | 0.2 | 0.2 | | 0.2 |
| Traction coefficient at 100° C. | | | | |
| Slide:roll ratio | | | | |
| 1 | 0.0017 | 0.002 | 0.0016 | 0.0015 |
| 5 | 0.0064 | 0.0068 | 0.0049 | 0.0057 |
| 10 | 0.0103 | 0.0109 | 0.0085 | 0.0084 |
| 20 | 0.0156 | 0.0162 | 0.0135 | 0.0135 |
| 50 | 0.0224 | 0.0231 | 0.0204 | 0.0202 |

The traction coefficient data indicates that copolymer A and copolymer B have similar performance when used alone. However, when used in combination, the traction coefficient was lowered demonstrating a synergy when the copolymers are used in combination.

Further improvements in traction coefficient were observed by adding a mixture of esters to Samples 12-15. Samples 16-18 all contain a 50:50 mixture of a mono ester and a di-ester. Sample 16 contained only copolymer A, sample 17 contained only copolymer B and Sample 18 contained the 80/20 mixture of copolymer A/copolymer B.

TABLE 8

| Grp III Formulations | | | |
|---|---|---|---|
| | Sample 16 | Sample 17 | Sample 18 |
| Baseoil | Grp III | Grp III | Grp III |
| Base oil viscosity at 100° C. | 4 cSt | 4 cSt | 4 cSt |
| Additive package | 12.5 | 12.5 | 12.5 |
| Copolymer A | 16.5 | | 12.8 |
| Copolymer B | | 20 | 3.2 |
| Ester 1 | 6.25 | 6.25 | 6.25 |
| Ester 2 | 6.25 | 6.25 | 6.25 |
| Traction coefficient at 100° C. | | | |
| 1 | 0.0015 | 0.0014 | 0.0011 |
| 5 | 0.0046 | 0.0045 | 0.004 |
| 10 | 0.0081 | 0.0078 | 0.0072 |
| 20 | 0.0127 | 0.0125 | 0.0117 |
| 50 | 0.0196 | 0.0192 | 0.0183 |

Traction coefficients for Samples 16-18 that contained the ester mixture were all lower than samples 12-15 that did not contain the ester mixture. Again, a synergistic improvement in the traction coefficient was observed for the 80/20 copolymer mixture compared to either of the copolymers alone.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

A lubricant composition comprising: a) a hydrocarbon lubricating base stock, b) a viscosity modifier composition comprising a weight ratio of between 90/10 to 40/60 wt % of polymer bi)/bii) of: bi) at least one olefin copolymer having a number average molecular weight ("Mn") as measured by Gel Permeation Chromatography ("GPC") with a polystyrene standard of about 1000 to about 10,000, bii) at least one grafted olefin copolymer having an Mn as measured by GPC with a polystyrene standard of about 1000 to about 10,000, comprising carboxylic acid functionality or a reactive equivalent thereof grafted onto the polymer backbone, wherein the carboxylic acid functionality or reactive equivalent thereof is further substituted with an amine.

The lubricant composition of any previous sentence, wherein the weight ratio of bi)/bii) is between 85/15 to 45/55 wt %.

The lubricant composition of any previous sentence, wherein the weight ratio of bi)/bii) is between 80/20 to 50/50 wt %.

The lubricant composition of any previous sentence, wherein the olefin polymer of i) comprises an ethylene/propylene copolymer.

The lubricant composition of any previous sentence, wherein the olefin polymer of i) comprises an ethylene-$C_3$-$C_{10}$ alpha-mono-olefin copolymer.

The lubricant composition of any previous sentence, wherein the olefin polymer of i) comprises an ethylene-$C_3$-$C_8$ alpha-mono-olefin copolymer.

The lubricant composition of any previous sentence, wherein the olefin polymer of i) comprises an ethylene-$C_3$-$C_6$ alpha-mono-olefin copolymer.

The lubricant composition of any previous sentence, wherein the olefin polymer of i) comprises an isobutylene polymer.

The lubricant composition of any previous sentence, wherein the olefin polymer of i) comprises an isoprene polymer.

The lubricant composition of any previous sentence, wherein the olefin polymer of i) comprises an ethylene-propylene-alpha olefin terpolymers.

The lubricant composition of any previous sentence, wherein the olefin polymer of i) comprises an ethylene-propylene polymer further containing a non-conjugated diene of 5 to 14 carbon atoms.

The lubricant composition of any previous sentence, wherein the olefin polymer of i) comprises an isobutylene/conjugated diene polymer of 5 to 14 carbon atoms.

The lubricant composition of any previous sentence, wherein the olefin polymer of i) comprises 15 to 80 mole % ethylene, and 20 to 85 mole % propylene or higher monoolefin.

The lubricant composition of any previous sentence, wherein the olefin polymer of i) comprises 30 to 80 mole % ethylene and 20 to 70 mole % of at least one $C_3$ to $C_{10}$ alpha monoolefin.

The lubricant composition of any previous sentence, wherein the olefin polymer of i) comprises 40 to 80 mole % ethylene and 20 to 60 mole % propylene.

The lubricant composition of any previous sentence, wherein the olefin polymer of i) comprises 15 to 80 mole % propylene and 20 to 85 mole % ethylene or higher monoolefin.

The lubricant composition of any previous sentence, wherein the olefin polymer of i) comprises 30 to 80 mole % propylene and 20 to 70 mole % of at least one $C_3$ to $C_{10}$ alpha monoolefin.

The lubricant composition of any previous sentence, wherein the olefin polymer of i) comprises 45 to 75 mole % propylene and 25 to 55 mole % ethylene.

The lubricant composition of any previous sentence, wherein the olefin polymer of i) comprises 15 mole % of a non-conjugated diene or triene.

The lubricant composition of any previous sentence, wherein the olefin polymer of i) has an Mn of about 1250 to about 9500.

The lubricant composition of any previous sentence, wherein the olefin polymer of i) has an Mn of about 1500 to about 9000.

The lubricant composition of any previous sentence, wherein the olefin polymer of i) has an Mn of about 1750 to about 8500.

The lubricant composition of any previous sentence, wherein the olefin polymer of i) has an Mn of about 2000 to about 8000.

The lubricant composition of any previous sentence, wherein the olefin polymer of i) has an Mn of about 2500 to about 7000.

The lubricant composition of any previous sentence, wherein the olefin polymer of i) has an Mn of 2500 to about 7500.

The lubricant composition of any previous sentence, wherein the olefin polymer of i) has an Mn of about 3000 to about 6500.

The lubricant composition of any previous sentence, wherein the olefin polymer of i) has an Mn of about 4000 to about 6000.

The lubricant composition of any previous sentence, wherein the olefin polymer of i) has an Mn of about 1000 to 5000.

The lubricant composition of any previous sentence, wherein the olefin polymer of i) has an Mn of about 1500 to about 4000.

The lubricant composition of any previous sentence, wherein the olefin polymer of i) has an Mn of about 2000 to about 4000.

The lubricant composition of any previous sentence, comprising 0.1 to 20 wt. % of the olefin polymer of i).

The lubricant composition of any previous sentence, comprising 1 to 19 wt. % of the olefin polymer of i).

The lubricant composition of any previous sentence, comprising 2.5 to 18 wt. % of the olefin polymer of i).

The lubricant composition of any previous sentence, comprising 5 to 17 wt. % of the olefin polymer of i).

The lubricant composition of any previous sentence, comprising 10 to 16 wt. % of the olefin polymer of i).

The lubricant composition of any previous sentence, comprising 10 to 20 wt. % of the olefin polymer of i).

The lubricant composition of any previous sentence, comprising 11 to 19 wt. % of the olefin polymer of i).

The lubricant composition of any previous sentence, comprising 12 to 18 wt. % of the olefin polymer of i).

The lubricant composition of any previous sentence, comprising 13 to 17 wt. % of the olefin polymer of i).

The lubricant composition of any previous sentence, comprising 14 to 16 wt. % of the olefin polymer of i).

The lubricant composition of any previous sentence, comprising 0.1 to 10 wt. % of the olefin polymer of i).

The lubricant composition of any previous sentence, comprising 0.2 to 9 wt. % of the olefin polymer of i).

The lubricant composition of any previous sentence, comprising 0.3 to 8 wt. % of the olefin polymer of i).

The lubricant composition of any previous sentence, comprising 0.4 to 7 wt. % of the olefin polymer of i).

The lubricant composition of any previous sentence, comprising 0.5 to 6 wt. % of the olefin polymer of i).

The lubricant composition of any previous sentence, comprising 0.2 to 9 wt. % of the grafted olefin polymer of i).

The lubricant composition of any previous sentence, comprising 0.3 to 8 wt. % of the grafted olefin polymer of i).

The lubricant composition of any previous sentence, comprising 0.4 to 7 wt. % of the grafted olefin polymer of i).

The lubricant composition of any previous sentence, comprising 0.5 to 6 wt. % of the grafted olefin polymer of i).

The lubricant composition of any previous sentence, wherein the grafted olefin polymer comprises an olefin polymer according to any previous sentence.

The lubricant composition of any previous sentence, wherein the grafted olefin polymer comprises a maleic acid graft.

The lubricant composition of any previous sentence, wherein the grafted olefin polymer comprises a maleic anhydride graft.

The lubricant composition of any previous sentence, wherein the grafted olefin polymer comprises a maleate.

The lubricant composition of any previous sentence, wherein the grafted olefin polymer comprises a itaconic acid graft.

The lubricant composition of any previous sentence, wherein the grafted olefin polymer comprises a itaconic anhydride graft.

The lubricant composition of any previous sentence, wherein the grafted olefin polymer comprises a itaconate.

The lubricant composition of any previous sentence, wherein the grafted olefin polymer comprises a cinnamic acid graft.

The lubricant composition of any previous sentence, wherein the grafted olefin polymer comprises a cinnamic anhydride graft.

The lubricant composition of any previous sentence, wherein the grafted olefin polymer comprises a cinnamate.

The lubricant composition of any previous sentence, wherein the grafted olefin polymer comprises a fumaric acid graft.

The lubricant composition of any previous sentence, wherein the grafted olefin polymer comprises a fumaric anhydride graft.

The lubricant composition of any previous sentence, wherein the grafted olefin polymer comprises a fumarate.

The lubricant composition of any previous sentence, wherein the grafted olefin polymer comprises a glyoxylic acid graft.

The lubricant composition of any previous sentence, wherein the grafted olefin polymer comprises a glyoxylic anhydride graft.

The lubricant composition of any previous sentence, wherein the grafted olefin polymer comprises a glyoxylate.

The lubricant composition of any previous sentence, wherein the grafted olefin polymer comprises the carboxylic acid graft at 0.5 to 8 weight percent based on the weight of the polymer backbone.

The lubricant composition of any previous sentence, wherein the grafted olefin polymer comprises the carboxylic acid graft at 1 to 7 weight percent based on the weight of the polymer backbone.

The lubricant composition of any previous sentence, wherein the grafted olefin polymer comprises the carboxylic acid graft at 1.5 to 6 weight percent based on the weight of the polymer backbone.

The lubricant composition of any previous sentence, wherein the grafted olefin polymer comprises the carboxylic acid graft at 2 to 5 weight percent based on the weight of the polymer backbone.

The lubricant composition of any previous sentence, wherein the grafted olefin polymer comprises the carboxylic acid graft at 1 to 2 weight percent based on the weight of the polymer backbone.

The lubricant composition of any previous sentence, wherein the grafted olefin polymer comprises the carboxylic acid graft at 2 to 3 weight percent based on the weight of the polymer backbone.

The lubricant composition of any previous sentence, wherein the grafted olefin polymer comprises the carboxylic acid graft at 3 to 4 weight percent based on the weight of the polymer backbone.

The lubricant composition of any previous sentence, wherein the grafted olefin polymer comprises the carboxylic acid graft at 4 to 5 weight percent based on the weight of the polymer backbone.

The lubricant composition of any previous sentence, wherein the grafted olefin polymer is grafted to a total acid number ("TAN") according to ASTM D664 of 5 to 100 mgKOH/g.

The lubricant composition of any previous sentence, wherein the grafted olefin polymer is grafted to a total acid number ("TAN") according to ASTM D664 of 10 to 80 mgKOH/g.

The lubricant composition of any previous sentence, wherein the grafted olefin polymer is grafted to a total acid number ("TAN") according to ASTM D664 of 15 to 75 mgKOH/g.

The lubricant composition of any previous sentence, wherein the grafted olefin polymer is grafted to a total acid number ("TAN") according to ASTM D664 of 20 to 70 mgKOH/g.

The lubricant composition of any previous sentence, wherein the grafted olefin polymer is grafted to a total acid number ("TAN") according to ASTM D664 of 25 to 65 mgKOH/g.

The lubricant composition of any previous sentence, wherein the grafted olefin polymer is grafted to a total acid number ("TAN") according to ASTM D664 of 25 to about 60 mgKOH/g.

The lubricant composition of any previous sentence, wherein the grafted olefin polymer is substantially free of poly(ethyleneamine).

The lubricant composition of any previous sentence, wherein the grafted olefin polymer is reacted with a primary amine.

The lubricant composition of any previous sentence, wherein the grafted olefin polymer is reacted with aniline.

The lubricant composition of any previous sentence, wherein the grafted olefin polymer is reacted with an N-alkylaniline.

The lubricant composition of any previous sentence, wherein the grafted olefin polymer is reacted with di-(para-methylphenyl)amine.

The lubricant composition of any previous sentence, wherein the grafted olefin polymer is reacted with naphthylamine.

The lubricant composition of any previous sentence, wherein the grafted olefin polymer is reacted with 4-aminodiphenylamine.

The lubricant composition of any previous sentence, wherein the grafted olefin polymer is reacted with N,N-dimethylphenylenediamine.

The lubricant composition of any previous sentence, wherein the grafted olefin polymer is reacted with 4-(4-nitrophenylazo)aniline.

The lubricant composition of any previous sentence, wherein the grafted olefin polymer is reacted with sulfamethazine.

The lubricant composition of any previous sentence, wherein the grafted olefin polymer is reacted with 4-phenoxyaniline.

The lubricant composition of any previous sentence, wherein the grafted olefin polymer is reacted with 3-nitroaniline.

The lubricant composition of any previous sentence, wherein the grafted olefin polymer is reacted with 4-aminoacetanilide.

The lubricant composition of any previous sentence, wherein the grafted olefin polymer is reacted with 4-amino-2-hydroxy-benzoic acid phenyl ester (phenyl amino salicylate).

The lubricant composition of any previous sentence, wherein the grafted olefin polymer is reacted with N-(4-amino-5-methoxy-2-methyl-phenyl)-benzamide.

The lubricant composition of any previous sentence, wherein the grafted olefin polymer is reacted with N-(4-amino-2,5-dimethoxy-phenyl)-benzamide.

The lubricant composition of any previous sentence, wherein the grafted olefin polymer is reacted with N-(4-amino-2,5-diethoxy-phenyl)-benzamide.

The lubricant composition of any previous sentence, wherein the grafted olefin polymer is reacted with N-(4-amino-phenyl)-benzamide.

The lubricant composition of any previous sentence, wherein the grafted olefin polymer is reacted with 4-phenylazoaniline.

The lubricant composition of any previous sentence, wherein the grafted olefin polymer is reacted with para-ethoxyaniline.

The lubricant composition of any previous sentence, wherein the grafted olefin polymer is reacted with para-dodecylaniline.

The lubricant composition of any previous sentence, wherein the grafted olefin polymer is reacted with cyclohexyl-substituted naphthylamine.

The lubricant composition of any previous sentence, wherein the grafted olefin polymer is reacted with thienyl-substituted aniline.

The lubricant composition of any previous sentence, wherein the grafted olefin polymer is reacted with 3-aminoquinoline.

The lubricant composition of any previous sentence, wherein the grafted olefin polymer is reacted with 5-aminoquinoline.

The lubricant composition of any previous sentence, wherein the grafted olefin polymer is reacted with 8-aminoquinoline.

The lubricant composition of any previous sentence, wherein the grafted olefin polymer is reacted with 2-aminobenzimidazole.

The lubricant composition of any previous sentence, wherein the grafted olefin polymer is reacted with N-(4-anilinophenyl)-3-aminobutanamide.

The lubricant composition of any previous sentence, wherein the grafted olefin polymer is reacted with aminocarbazoles.

The lubricant composition of any previous sentence, wherein the grafted olefin polymer is reacted with aminoindoles.

The lubricant composition of any previous sentence, wherein the grafted olefin polymer is reacted with aminopyrroles.

The lubricant composition of any previous sentence, wherein the grafted olefin polymer is reacted with aminoindazolinones.

The lubricant composition of any previous sentence, wherein the grafted olefin polymer is reacted with aminoperimidines.

The lubricant composition of any previous sentence, wherein the grafted olefin polymer is reacted with mercaptotriazoles.

The lubricant composition of any previous sentence, wherein the grafted olefin polymer is reacted with aminophenothiazines.

The lubricant composition of any previous sentence, wherein the grafted olefin polymer is reacted with aminopyridiens.

The lubricant composition of any previous sentence, wherein the grafted olefin polymer is reacted with aminopyrazines.

The lubricant composition of any previous sentence, wherein the grafted olefin polymer is reacted with aminopyrimidines.

The lubricant composition of any previous sentence, wherein the grafted olefin polymer is reacted with pyridines.

The lubricant composition of any previous sentence, wherein the grafted olefin polymer is reacted with pyrazines.

The lubricant composition of any previous sentence, wherein the grafted olefin polymer is reacted with pyrimidines.

The lubricant composition of any previous sentence, wherein the grafted olefin polymer is reacted with aminothiadiazoles.

The lubricant composition of any previous sentence, wherein the grafted olefin polymer is reacted with aminothiothiadiazoles.

The lubricant composition of any previous sentence, wherein the grafted olefin polymer is reacted with aminobenzotriaozles.

The lubricant composition of any previous sentence, wherein the grafted olefin polymer is reacted with 3-amino-N-(4-anilinophenyl)-N-isopropyl butanamide.

The lubricant composition of any previous sentence, wherein the grafted olefin polymer is reacted with N-(4-anilinophenyl)-3-{(3-aminopropyl)-(cocoalkyl)amino} butanamide.

The lubricant composition of any previous sentence, wherein the grafted olefin polymer is reacted with materials of the general structure $\phi$-CONH-$\phi$-$NH_2$ where the phenyl groups may be substituted.

The lubricant composition of any previous sentence, wherein the grafted olefin polymer is reacted with methylamine.

The lubricant composition of any previous sentence, wherein the grafted olefin polymer is reacted with ethylamine.

The lubricant composition of any previous sentence, wherein the grafted olefin polymer is reacted with propylamine.

The lubricant composition of any previous sentence, wherein the grafted olefin polymer is reacted with dimethylaminopropylamine.

The lubricant composition of any previous sentence, wherein the grafted olefin polymer is reacted with dimethylaminopropylamine.

The lubricant composition of any previous sentence, wherein the grafted olefin polymer is reacted with dibutylaminopropylamine.

The lubricant composition of any previous sentence, wherein the grafted olefin polymer is reacted with dimethylaminoethylamine.

The lubricant composition of any previous sentence, wherein the grafted olefin polymer is reacted with diethylaminoethylamine.

The lubricant composition of any previous sentence, wherein the grafted olefin polymer is reacted with dibutylaminoethylamine.

The lubricant composition of any previous sentence, wherein the grafted olefin polymer is reacted with 1-(2-aminoethyl)piperidine.

The lubricant composition of any previous sentence, wherein the grafted olefin polymer is reacted with 1-(2-aminoethyl)pyrrolidone.

The lubricant composition of any previous sentence, wherein the grafted olefin polymer is reacted with N,N-dimethylethylamine.

The lubricant composition of any previous sentence, wherein the grafted olefin polymer is reacted with 3-(dimethylamino)-1-propylamine.

The lubricant composition of any previous sentence, wherein the grafted olefin polymer is reacted with O-(2-aminopropyl)-O'-(2-methoxyethyl)polypropylene glycol.

The lubricant composition of any previous sentence, wherein the grafted olefin polymer is reacted with N,N-dimethyldipropylenetriamine.

The lubricant composition of any previous sentence, wherein the grafted olefin polymer is reacted with aminoethylmorpholine.

The lubricant composition of any previous sentence, wherein the grafted olefin polymer is reacted with 3-morpholinopropylamine.

The lubricant composition of any previous sentence, wherein the grafted olefin polymer is reacted with aminoethylethyleneurea.

The lubricant composition of any previous sentence, wherein the grafted olefin polymer is reacted with aminopropylmorpholine.

The lubricant composition of any previous sentence, wherein the grafted olefin polymer has a nitrogen content, calculated using ASTM D5291, of 0.05 to 3 percent by weight.

The lubricant composition of any previous sentence, wherein the grafted olefin polymer has a nitrogen content, calculated using ASTM D5291, of 0.1 to 2.5 percent by weight.

The lubricant composition of any previous sentence, wherein the grafted olefin polymer has a nitrogen content, calculated using ASTM D5291, of 0.15 to 2 percent by weight.

The lubricant composition of any previous sentence, wherein the grafted olefin polymer has a nitrogen content, calculated using ASTM D5291, of 0.2 to 1.75 percent by weight.

The lubricant composition of any previous sentence, wherein the grafted olefin polymer has a nitrogen content, calculated using ASTM D5291, of 0.25 to 1.6 percent by weight.

The lubricant composition of any previous sentence, comprising 0.1 to 10 wt. % of the grafted olefin polymer.

The lubricant composition of any previous sentence, comprising 0.2 to 9 wt. % of the grafted olefin polymer.

The lubricant composition of any previous sentence, comprising 0.3 to 8 wt. % of the grafted olefin polymer.

The lubricant composition of any previous sentence, comprising 0.4 to 7 wt. % of the grafted olefin polymer.

The lubricant composition of any previous sentence, comprising 0.5 to 6 wt. % of the grafted olefin polymer.

The lubricant composition of any previous sentence, comprising c) a carboxylic acid ester.

The lubricant composition of any previous sentence, wherein the carboxylic acid ester comprises a carboxylic acid mono-ester.

The lubricant composition of any previous sentence, wherein the carboxylic acid mono-ester comprises a $C_8$ to $C_{18}$ linear or branched carboxylic acid.

The lubricant composition of any previous sentence, wherein the carboxylic acid mono-ester comprises a $C_6$ to $C_{12}$ linear or branched alkoxy group.

The lubricant composition of any previous sentence, wherein the carboxylic acid mono-ester comprises a $C_4$ to $C_{14}$ linear or branched alkoxy group.

The lubricant composition of any previous sentence, wherein the carboxylic acid mono-ester comprises a $C_8$ to $C_{14}$ linear or branched alkoxy group.

The lubricant composition of any previous sentence, wherein the carboxylic acid mono-ester comprises a $C_{10}$ to $C_{14}$ linear or branched alkoxy group.

The lubricant composition of any previous sentence, wherein the carboxylic acid mono-ester comprises a $C_{11}$ to $C_{13}$ linear or branched alkoxy group.

The lubricant composition of any previous sentence, wherein the carboxylic acid mono-ester comprises a lauric acid mono-ester, tallow acid mono-ester, oleic acid mono-ester, palmitic acid mono ester, and combinations thereof.

The lubricant composition of any previous sentence, wherein the carboxylic acid mono-ester comprises a 2-ethylhexyl alkoxy group.

The lubricant composition of any previous sentence, wherein the carboxylic acid mono-ester comprises 2-ethylhexyl tallate.

The lubricant composition of any previous sentence, wherein the carboxylic acid mono-ester comprises 2-ethylhexyl oleate.

The lubricant composition of any previous sentence, wherein the carboxylic acid mono-ester comprises 2-ethylhexyl laurate.

The lubricant composition of any previous sentence, wherein the carboxylic acid mono-ester comprises 2-ethylhexyl palmitate.

The lubricant composition of any previous sentence, wherein the mono-ester is present at from about 1.5 to about 15 wt. %.

The lubricant composition of any previous sentence, wherein the mono-ester is present at from about 2 to about 12.5 wt. %.

The lubricant composition of any previous sentence, wherein the mono-ester is present at from about 3 to about 10 wt. %.

The lubricant composition of any previous sentence, wherein the mono-ester is present at from about 4 to about 8 wt. %.

The lubricant composition of any previous sentence, wherein the mono-ester is present at from about 10 to about 15 wt. %.

The lubricant composition of any previous sentence, wherein the carboxylic acid ester comprises a dicarboxylic acid di-ester.

The lubricant composition of any previous sentence, wherein the dicarboxylic acid di-ester comprises a $C_3$ to $C_2$ linear or branched dicarboxylic acid.

The lubricant composition of any previous sentence, wherein the dicarboxylic acid di-ester comprises a $C_4$ to $C_{11}$ linear or branched dicarboxylic acid.

The lubricant composition of any previous sentence, wherein the dicarboxylic acid di-ester comprises a $C_5$ to $C_{10}$ linear or branched dicarboxylic acid.

The lubricant composition of any previous sentence, wherein the dicarboxylic acid di-ester comprises a $C_6$ to $C_9$ linear or branched dicarboxylic acid.

The lubricant of any previous sentence, where the dicarboxylic acid di-ester comprises adipic acid di-ester, azelaic acid di-ester, and combinations thereof.

The lubricant composition of any previous claim, wherein the dicarboxylic acid di-ester comprises di-2-ethylhexyl azelate.

The lubricant composition of any previous sentence, wherein the dicarboxylic acid di-ester comprises diisotridecyl adipate.

The lubricant composition of any previous sentence, wherein the dicarboxylic acid di-ester comprises diisooctyl adipate.

The lubricant composition of any previous sentence, wherein the dicarboxylic acid di-ester comprises di-$C_{6-10}$-azelate.

The lubricant composition of any previous sentence, wherein the dicarboxylic acid di-ester comprises di-$C_{6-10}$-adipate.

The lubricant composition of any previous sentence, wherein the dicarboxylic acid di-ester comprises di-$C_8$-azelate.

The lubricant composition of any previous sentence, wherein the dicarboxylic acid di-ester comprises di-$C_8$ adipate.

The lubricant composition of any previous sentence, wherein the di-ester is present at from about 1 to about 15 wt. %.

The lubricant composition of any previous sentence, wherein the di-ester is present at from about 1.5 to about 15 wt. %.

The lubricant composition of any previous sentence, wherein the di-ester is present at from about 2 to about 12.5 wt. %.

The lubricant composition of any previous sentence, wherein the di-ester is present at from about 3 to about 10 wt. %.

The lubricant composition of any previous sentence, wherein the di-ester is present at from about 4 to about 8 wt. %.

The lubricant composition of any previous sentence, wherein the di-ester is present at from about 10 to about 15 wt. %.

The lubricant composition of any previous sentence, wherein the total amount of carboxylic acid mono-ester and dicarboxylic acid di-ester is from about 2 to about 30 wt. %.

The lubricant composition of any previous sentence, wherein the total amount of carboxylic acid mono-ester and dicarboxylic acid di-ester is from about 3 to about 30 wt. %.

The lubricant composition of any previous sentence, wherein the total amount of carboxylic acid mono-ester and dicarboxylic acid di-ester is from about 4 to about 25 wt. %.

The lubricant composition of any previous sentence, wherein the total amount of carboxylic acid mono-ester and dicarboxylic acid di-ester is from about 20 to about 30 wt. %.

The lubricant composition of any previous sentence, wherein the total amount of carboxylic acid mono-ester and dicarboxylic acid di-ester is from about 6 to about 20 wt. %.

The lubricant composition of any previous sentence, wherein the total amount of carboxylic acid mono-ester and dicarboxylic acid di-ester is from about 8 to about 16 wt. %.

The lubricant composition of any previous sentence, wherein the total amount of carboxylic acid mono-ester and dicarboxylic acid di-ester is from about 10 to about 14 wt. %.

The lubricant composition of any previous sentence, wherein the ratio of carboxylic acid mono-ester to dicarboxylic acid di-ester is from 90 wt. %:10 wt. % to 10 wt. %:90 wt. %.

The lubricant composition of any previous sentence, wherein the ratio of carboxylic acid mono-ester to dicarboxylic acid di-ester is from 80 wt. %:20 wt. % to 20 wt. %:80 wt. %.

The lubricant composition of any previous sentence, wherein the ratio of carboxylic acid mono-ester to dicarboxylic acid di-ester is from 75 wt. %:25 wt. % to 25 wt. %:75 wt. %.

The lubricant composition of any previous sentence, wherein the ratio of carboxylic acid mono-ester to dicarboxylic acid di-ester is from 60 wt. %:40 wt. % to 40 wt. %:60 wt. %.

The lubricant composition of any previous sentence, wherein the ratio of carboxylic acid mono-ester to dicarboxylic acid di-ester is from 55 wt. %:45 wt. % to 45 wt. %:55 wt. %.

The lubricant composition of any previous sentence, wherein the ratio of carboxylic acid mono-ester to dicarboxylic acid di-ester is 50 wt. %:50 wt. %.

The lubricant composition of any previous sentence wherein the hydrocarbon lubricating base stock comprises an American Petroleum Institute ("API") Group IV polyalphaolefin.

The lubricant composition of any previous sentence wherein the hydrocarbon lubricating base stock comprises an American Petroleum Institute ("API") Group III oil mineral oil.

The lubricant composition of any previous sentence wherein the hydrocarbon lubricating base stock comprises an American Petroleum Institute ("API") Group II oil mineral oil.

The lubricant composition of any previous sentence comprising a total sulfur level from all additives (i.e., not including base oil) of about 0.5 to about 3 wt. %.

The lubricant composition of any previous sentence comprising a total sulfur level from all additives (i.e., not including base oil) of about 0.6 to about 3 wt. %.

The lubricant composition of any previous sentence comprising a total sulfur level from all additives (i.e., not including base oil) of about 0.5 to about 2.5 wt. %

The lubricant composition of any previous sentence comprising a total sulfur level from all additives (i.e., not including base oil) of about 0.6 to about 2.5 wt. %.

The lubricant composition of any previous sentence comprising a total sulfur level from all additives (i.e., not including base oil) of about 0.5 to about 2 wt. %.

The lubricant composition of any previous sentence comprising a total sulfur level from all additives (i.e., not including base oil) of about 0.6 to about 2 wt. %.

The lubricant composition of any previous sentence comprising a total sulfur level from all additives (i.e., not including base oil) of about 0.2 to about 0.75 wt %.

The lubricant composition of any previous sentence comprising a total sulfur level from all additives (i.e., not including base oil) of about 0.25 to about 0.5 wt. %.

The lubricant composition of any previous sentence comprising a total phosphorus level of about 0.03 to about 0.5 wt. %.

The lubricant composition of any previous sentence comprising a total phosphorus level of about 0.03 to about 0.35 wt. %.

The lubricant composition of any previous sentence comprising a total phosphorus level of about 0.05 to about 0.3 wt. %.

The lubricant composition of any previous sentence comprising a total phosphorus level of about 0.08 to about 0.2 wt. %.

The lubricant composition of any previous sentence comprising a total phosphorus level of about 0.13 to about 0.2 wt. %.

The lubricant composition of any previous sentence comprising a total phosphorus level of about 0.1 to about 0.25 wt. %.

The lubricant composition of any previous sentence having a kinematic viscosity at 100° C. by ASTM D445 of 3 to 28 $mm^2/s$.

The lubricant composition of any previous sentence having a kinematic viscosity at 100° C. by ASTM D445 of 3.5 to 26 $mm^2/s$.

The lubricant composition of any previous sentence having a kinematic viscosity at 100° C. by ASTM D445 of 4 to 24 $mm^2/s$.

The lubricant composition of any previous sentence having a kinematic viscosity at 100° C. by ASTM D445 of 4.5 to 22 $mm^2/s$.

The lubricant composition of any previous sentence having a kinematic viscosity at 100° C. by ASTM D445 of 3.8 to 5.0 $mm^2/s$.

The lubricant composition of any previous sentence having a kinematic viscosity at 100° C. by ASTM D445 of 5.0 to 6.5 $mm^2/s$.

The lubricant composition of any previous sentence having a kinematic viscosity at 100° C. by ASTM D445 of 6.6 to 8.5 $mm^2/s$.

The lubricant composition of any previous sentence having a kinematic viscosity at 100° C. by ASTM D445 of 8.5 to 11.0 $mm^2/s$.

The lubricant composition of any previous sentence having a kinematic viscosity at 100° C. by ASTM D445 of 5.5 to 7 $mm^2/s$.

The lubricant composition of any previous sentence having a kinematic viscosity at 100° C. by ASTM D445 of 5 to 6.5 $mm^2/s$.

The lubricant composition of any previous sentence having a kinematic viscosity at 100° C. by ASTM D445 of 5 to 6 $mm^2/s$.

The lubricant composition of any previous sentence having a kinematic viscosity at 100° C. by ASTM D445 of 3.8 to 6.5 $mm^2/s$.

The lubricant composition of any previous sentence having a kinematic viscosity at 100° C. by ASTM D445 of 6.5 to 11.0 $mm^2/s$.

The lubricant composition of any previous sentence having a kinematic viscosity at 100° C. by ASTM D445 of 11.0 to 13.5 $mm^2/s$.

The lubricant composition of any previous sentence having a kinematic viscosity at 100° C. by ASTM D445 of 13.5 to 18.5 $mm^2/s$.

The lubricant composition of any previous sentence having a kinematic viscosity at 100° C. by ASTM D445 of 18.5 to 28 $mm^2/s$.

A method of improving traction coefficient in a lubricated gear, comprising supplying to the gear a lubricant composition according to any previous sentence.

The method of the previous sentence, wherein the lubricant composition is provided at a temperature of less than 100° C.

A method for lubricating a gear by supplying thereto the lubricant composition of any previous paragraph.

The method of the previous sentence wherein the gear comprises bearings.

The method of any previous paragraph wherein the gear comprises hypoid gears.

The method of any previous paragraph wherein the gear comprises industrial gears.

The use of a mono-ester in a lubricant composition for a gear to improve traction coefficient.

The use according to the previous sentence, wherein the use is at a temperature of less than 100° C.

The use of a combination of an olefin polymer, a grafted olefin polymer, a mono-ester and di-ester in a lubricant composition for a gear to improve thermal stability and traction coefficient.

What is claimed is:

1. A lubricant composition comprising:

a) a hydrocarbon lubricating base stock, b) a viscosity modifier composition comprising a ratio of between 90/10 to 40/60 wt % of polymer i)/ii) of:

i) 0.1 to 20 wt. % of at least one olefin copolymer having a number average molecular weight ("Mn") as measured by Gel Permeation Chromatography ("GPC") with a polystyrene standard of about 1000 to about 10,000 wherein the olefin copolymer comprises an ethylene/propylene copolymer, ii) 0.1 to 10 wt. % of at least one grafted olefin copolymer having an Mn as measured by GPC with a polystyrene standard of about 1000 to about 10,000, comprising carboxylic acid functionality or a reactive equivalent thereof grafted onto a polymer backbone comprising an ethylene/propylene copolymer, wherein the carboxylic acid functionality or reactive equivalent thereof is further substituted with an amine.

2. The lubricant composition of claim 1 wherein the copolymer of b) i) comprises 15 to 80 mole % ethylene, and 20 to 85 mole % propylene or higher monoolefin or comprises 30 to 80 mole % ethylene and 20 to 70 mole % of at least one $C_3$ to $C_{10}$ alpha monoolefin or comprises 40 to 80 mole % ethylene and 20 to 60 mole % propylene or comprises 15 to 80 mole % propylene and 20 to 85 mole % ethylene or higher monoolefin.

3. The lubricant composition of claim 1 wherein the grafted copolymer of b) ii) comprises an ethylene/propylene copolymer backbone with grafted succinic anhydride functionality.

4. The lubricant composition of claim 2 wherein the succinic anhydride functionality is substituted with a primary amine.

5. The lubricant composition of claim 2 wherein the succinic anhydride functionality is substituted with an aliphatic amine, heterocyclic amine, aromatic amine, or mixtures thereof.

6. The lubricant composition of claim 1, wherein the grafted olefin polymer is reacted with aminopropylmorpholine.

7. The lubricant composition of claim 1, wherein the grafted olefin polymer is reacted with dimethylaminopropylamine.

8. The lubricant composition of claim 1 comprising c) a carboxylic acid ester.

9. The lubricant composition of claim 8 wherein the carboxylic acid ester comprises c)i) a carboxylic acid monoester, c)ii) a dicarboxylic acid di-ester, and c)iii) mixtures thereof.

10. The lubricant composition of claim 9, comprising from about 1 to about 15 wt. % of a carboxylic acid monoester.

11. The lubricant composition of claim 9, wherein the carboxylic acid mono-ester of c)i) comprises a $C_8$ to $C_{18}$ or $C_4$ to $C_{14}$ or $C_8$ to $C_{14}$ or $C_{10}$ to $C_{14}$ or $C_{11}$ to $C_{13}$ linear or branched carboxylic acid.

12. The lubricant composition of claim 9, wherein the carboxylic acid mono-ester comprises a $C_6$ or $C_8$ to $C_{12}$ linear or branched alkoxy group.

13. The lubricant composition of claim 9, wherein the carboxylic acid mono-ester comprises a lauric acid mono-ester, tallow acid mono-ester, oleic acid mono-ester, palmitic acid mono ester, and combinations thereof.

14. The lubricant composition of claim 9, wherein the carboxylic acid mono-ester comprises a 2-ethylhexyl alkoxy group.

15. The lubricant composition of claim 9, wherein the carboxylic acid mono-ester comprises at least one of 2-ethylhexyl tallate, 2-ethylhexyl oleate, 2-ethylhexyl laurate, 2-ethylhexyl palmitate, and combinations thereof.

16. The lubricant composition of claim 9, comprising from about 1 to about 15 wt. % of the dicarboxylic acid di-ester.

17. The lubricant composition of claim 9, wherein the dicarboxylic acid di-ester comprises a $C_3$ to $C_{12}$, or a $C_4$ to $C_{11}$, or a $C_8$ to $C_{10}$, or $C_6$ to $C_9$ linear or branched dicarboxylic acid.

18. The lubricant of claim 9, where the dicarboxylic acid di-ester comprises adipic acid diester, azelaic acid diester, and combinations thereof.

19. The lubricant composition of claim 9, wherein the dicarboxylic acid di-ester comprises at least one of di-2-ethylhexyl azelate, diisotridecyl adipate, diisooctyl adipate, di-$C_{6-10}$-azelate, di-$C_{6-10}$-adipate, di-$C_8$-azelate, di-$C_8$ adipate and combinations thereof.

20. A method for lubricating a driveline system by supplying thereto the lubricant composition of claim 1.

21. A method for lubricating a gear by supplying thereto the lubricant composition of claim 1.

22. The method of claim 21 wherein the gear comprises bearings.

23. The method of claim 21 wherein the gear comprises hypoid gears.

24. The method of claim 21 wherein the gear comprises industrial gears.

* * * * *